US007493947B2

(12) United States Patent
Ross

(10) Patent No.: US 7,493,947 B2
(45) Date of Patent: Feb. 24, 2009

(54) WATER SHUT OFF METHOD AND APPARATUS

(75) Inventor: Donald W. Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 36 days.

(21) Appl. No.: 11/314,839

(22) Filed: Dec. 21, 2005

(65) Prior Publication Data

US 2006/0175065 A1 Aug. 10, 2006

Related U.S. Application Data

(60) Provisional application No. 60/593,206, filed on Dec. 21, 2004.

(51) Int. Cl.
*E21B 43/08* (2006.01)

(52) U.S. Cl. ..... 166/228; 166/386

(58) Field of Classification Search ..... 166/227–229, 166/236, 278, 320

See application file for complete search history.

(56) References Cited

U.S. PATENT DOCUMENTS

| | | | |
|---|---|---|---|
| 2,945,451 | A | 7/1960 | Griswold |
| 3,385,367 | A | 5/1968 | Kollsman |
| 4,862,967 | A | 9/1989 | Harris |
| 6,634,431 | B2 | 10/2003 | Cook et al. |
| 6,719,064 | B2 | 4/2004 | Price-Smith et al. |
| 6,722,437 | B2 | 4/2004 | Vercaemer et al. |
| 6,820,690 | B2 | 11/2004 | Vercaemer et al. |
| 6,834,725 | B2 | 12/2004 | Whanger et al. |
| 6,840,325 | B2 | 1/2005 | Stephenson |
| 6,848,505 | B2 | 2/2005 | Richard et al. |
| 6,854,522 | B2 | 2/2005 | Brezinski et al. |
| 6,976,542 | B2 * | 12/2005 | Henriksen et al. ..... 166/386 |
| 2002/0020527 | A1 | 2/2002 | Kilaas |
| 2003/0146003 | A1 | 8/2003 | Duggan et al. |
| 2004/0118572 | A1 | 6/2004 | Whanger et al. |

(Continued)

FOREIGN PATENT DOCUMENTS

| | | |
|---|---|---|
| GB | 0247593 | 1/1927 |

(Continued)

OTHER PUBLICATIONS

Al-Anazi, Hamoud A., Sharma, Mukul M.; Evaluation of a pH-Sensitive Polymer for Gravel-Packing Operations; SPE Production and Operations Symposium; Oklahoma City, OK; Mar. 24-27, 2001; SPE 67292; Society of Petroleum Engineers Inc., Richmond, TX.

(Continued)

*Primary Examiner*—Kenneth Thompson
(74) *Attorney, Agent, or Firm*—Daryl R. Wright; James L. Kurka

(57) ABSTRACT

A technique is provided to control flow in subterranean applications, such as hydrocarbon fluid production applications. The technique utilizes an material formed, at least in part, of material that swell in the presence of a specific substance or substances. The material is deployed as a membrane outside a base pipe to desired subterranean locations. Once located, the material allows the flow of hydrocarbon fluids but swells upon contact with the specific substance or substances to limit inflow of undesirable fluids.

14 Claims, 7 Drawing Sheets

U.S. PATENT DOCUMENTS

| | | | | |
|---|---|---|---|---|
| 2004/0123983 | A1 | 7/2004 | Cook et al. | |
| 2005/0072576 | A1 | 4/2005 | Henriksen et al. | |
| 2005/0072579 | A1 | 4/2005 | Gambier | |
| 2005/0252651 | A1 * | 11/2005 | Bosma et al. | 166/51 |

FOREIGN PATENT DOCUMENTS

| | | | | |
|---|---|---|---|---|
| GB | 2404397 | A | | 2/2005 |
| JP | 09317369 | A | * | 12/1997 |
| WO | 00/45031 | A1 | | 8/2000 |
| WO | WO 02/20941 | A1 | | 3/2002 |
| WO | WO 02/059452 | A1 | | 8/2002 |
| WO | WO 03/008756 | A1 | | 1/2003 |
| WO | WO 03/056125 | A2 | | 7/2003 |
| WO | WO 2004/005665 | A2 | | 1/2004 |
| WO | WO 2004/005669 | A1 | | 1/2004 |
| WO | WO 2004/018836 | A1 | | 3/2004 |
| WO | WO 2004/022911 | A3 | | 3/2004 |
| WO | WO 2004/027209 | A1 | | 4/2004 |
| WO | WO 2004/057715 | A3 | | 7/2004 |
| WO | WO 2004/101952 | A1 | | 11/2004 |
| WO | WO 2005/012686 | A1 | | 2/2005 |
| WO | 2005/056977 | A1 | | 6/2005 |
| WO | 2006003112 | A1 | | 1/2006 |

OTHER PUBLICATIONS

Al-Anazi, Hamoud A., Sharma, Mukul M.; Use of a pH-Sensitive Polymer for Conformance Control; SPE International Symposium and Exhibition on Formation Damage Control; Lafayette, LA; Feb. 20-21, 2002; SPE 73782; Society of Petroleum Engineers Inc., Richmond, TX.

Al-Anazi, Hamoud A., Sharma, Mukul M.; Evaluation of a pH-Sensitive Polymer for Gravel-Packing Operations; Revised manuscript (of SPE 67292); SPE 76813 revised Jan. 2, 2002; Society of Petroleum Engineers Inc., Richmond, TX.

* cited by examiner

WATER SHUT OFF METHOD AND APPARATUS

This application claims the benefit of U.S. Provisional Application No. 60/593,206, filed Dec. 21, 2004.

Federally sponsored research or development is not applicable.

A Sequence Listing is not applicable.

BACKGROUND OF THE INVENTION

Various subterranean formations contain hydrocarbons in fluid form which can be produced to a surface location for collection. However, many of these formations also contain fluids, e.g. water, including brine, and gases, which can intrude on the production of hydrocarbon fluids. Accordingly, it often is necessary to control the intrusion of water through various techniques, including mechanical separation of the water from the hydrocarbon fluids and controlling the migration of water to limit the intrusion of water into the produced hydrocarbon fluids. However, these techniques tend to be relatively expensive and complex.

In a typical production example, a wellbore is drilled into or through a hydrocarbon containing formation. The wellbore is then lined with a casing, and a completion, such as a gravel pack completion, is moved downhole. The completion, contains a screen through which hydrocarbon fluids flow from the formation to the interior of the completion for production to the surface. The annulus between the screen and the surrounding casing or wellbore wall often is gravel packed to control the buildup of sand around the screen. During production, a phenomenon known as watercut sometimes occurs in which water migrates along the wellbore towards the screen into which the hydrocarbon fluids flow for production. If the watercut becomes too high, water can mix with the produced hydrocarbon fluids. Unless this migration of water is controlled, the well can undergo a substantial reduction in efficiency or even be rendered no longer viable.

SUMMARY

In general, the present invention provides a system and method for controlling the undesirable flow of water in subterranean locations. In the production of hydrocarbon fluids, the system and method provide an economical technique for providing a screen or liner that limits or stops the intrusion of undesirable fluids shutting off the area for passage of fluid into a completion string in an affected zone. The system and method also can be utilized in other subterranean and production related environments and applications to control undesired fluid flow.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

By way of example, many production wells have the potential for water, or undesirable gas, inflow at some point in the life of the well. Water inflow, often in the form of watercut, can intrude on the hydrocarbon fluids being produced by a completion disposed in a wellbore. The incursion of water can lead to reduce hydrocarbon fluid production and can even rendered the well no longer viable for hydrocarbon production, unless the influx of water is blocked.

Figure 1:
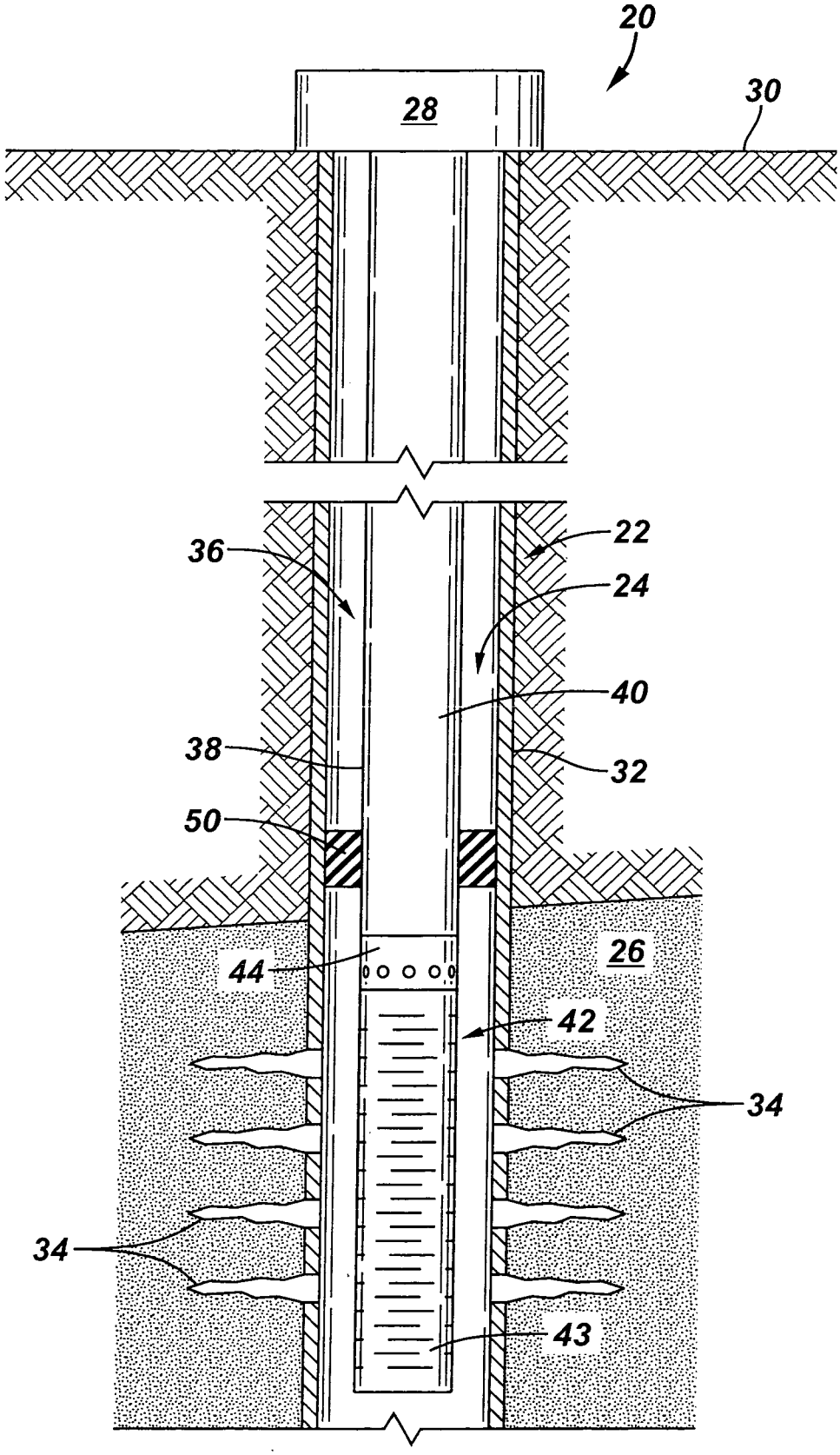
FIG. 1 is a schematic view of a well in which a completion has been positioned in a wellbore to receive a swell pack, according to an embodiment of the present invention.

In the embodiment of FIG. 1, a well site 20 is illustrated as having a well 22 comprising a wellbore 24 drilled into a formation 26. Wellbore 24 extends downwardly from a wellhead 28 positioned at a surface 30 of the earth. Wellbore 24 is lined by a casing 32 which may have perforations 34 through which fluids flow from formation 26 into wellbore 24 for production to a desired collection location.

Additionally, wellbore 24 provides access for well equipment 36 used in the production of hydrocarbon fluids from formation 26. In this embodiment, well equipment 36 may comprise a well completion 38 having, for example, tubing 40, e.g. production tubing, coupled to a screen 42 through which formation fluids flow radially inward for production. Screen 42 may be constructed in a variety of configurations, but is illustrated as a slotted liner 43.

In the embodiment illustrated, a packer 50 is provided to generally isolate the pack region of the wellbore. To form a pack, packer 50 is set to create a seal between tubing 40 and casing 32.

Figure 2A:
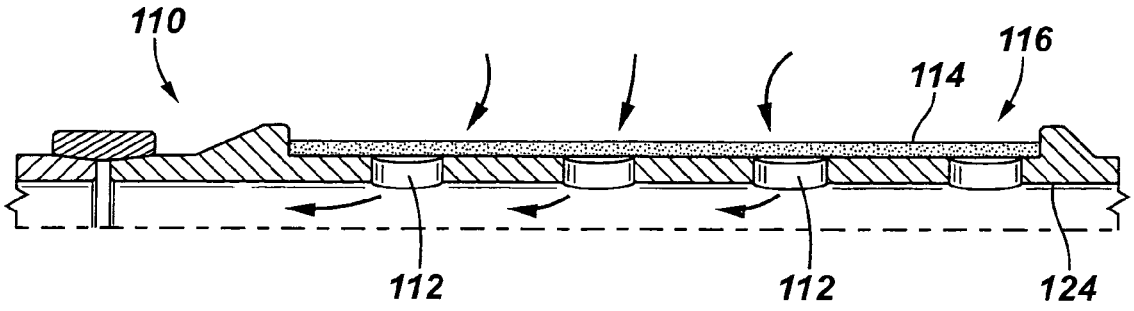
FIG. 2A is a cross-section view of a valve having a swellable component in a dormant condition, according to an embodiment of the present invention.

Turning to FIG. 2A, shown is an embodiment of this invention comprising a valve and system used to control the flow of water into or out of a well. The valve 110 comprises at least one port 112 and a membrane 114. The membrane 114 covers the ports 112. The membrane 114, however, is permeable to non-water fluids including hydrocarbons such that hydrocarbon fluid can flow through the membrane 114 and ports 112. This open state is called the open state 116. When the membrane 114 comes into contact with water from a subterranean formation, for example, the molecular condition of the membrane 114 changes so that the permeability or porosity of the membrane 114 decreases to the point where flow through the valve 110 is shut off. This is the closed state 118.

Figure 2B:
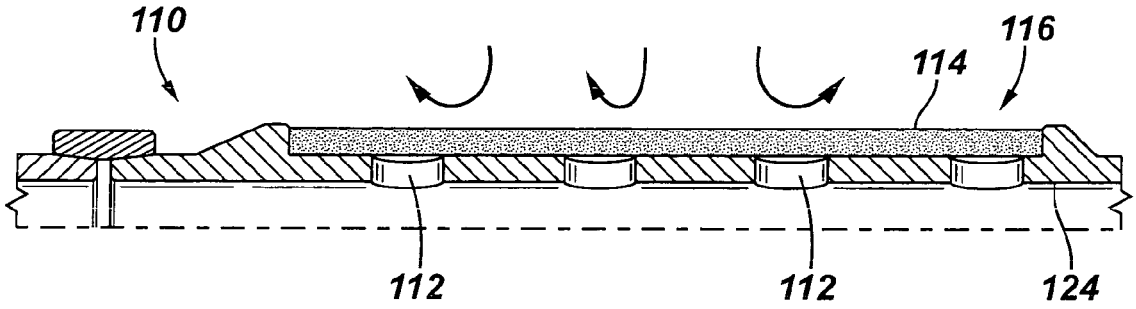
FIG. 2B is a cross-section view of a valve having a swellable component in a swollen condition, according to an embodiment of the present invention.

As shown in FIG. 2B, valve 110 progresses to a closed state 118 upon contact with an activating fluid, such as water. Membrane 114 decreases from its original permeability to a permeability that by comparison significantly restricts or prevents passage of fluid from the formation through the ports 12 and into the tubular. Upon contact with an activating fluid, such as water, membrane 114 swells to close any interstitial volumes created by the particles making up its composition. Thus, in the closed state 118 the valve 100 blocks intrusion of undesirable fluid migrating along the wellbore due to, for example, potential watercut that would otherwise result due to the production of hydrocarbon fluids from the formation.

Figure 2C:
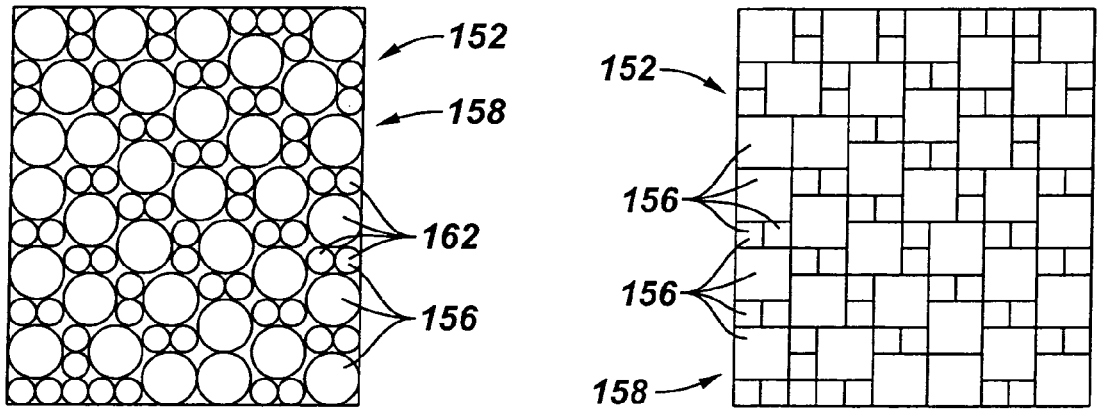
FIG. 2C is an enlarged illustration of an aggregate formed of a mixture of swellable particles used to create the swell pack, according to an embodiment of the present invention.

In the embodiment illustrated in FIG. 2C, at least a portion of particles 156 are swellable particles 162 that swell or expand when exposed to a specific substance or substances. For example, swellable particles 162 may be formed from a material that swells in the presence of water. Alternatively, the swellable particles may be formed from a material that expands in the presence of a specific chemical or chemicals. This latter embodiment enables the specific actuation of the swellable particles by, for example, pumping the chemical(s) downhole to cause swelling of particles 162 and pack 158 at a specific time. Additionally, aggregate 152 can be a mixture of swellable particles and conventional particles. In this embodiment, the swellable particles expand and swell against each other and against the conventional particles to reduce or eliminate the interstitial volumes between particles. In another embodiment, the particles forming aggregate 152 are substantially all swellable particles 162 that expand when exposed to water. In this latter embodiment, all particles exposed to water swell to reduce or eliminate the interstitial volumes between particles. In the embodiment of FIG. 2C, for example, the particles 156 are substantially all swellable particles 162 that have been exposed to water, or another swell inducing substance, which has caused the particles to expand into the interstitial volumes. Accordingly, the swellable pack 158 has one permeability when flowing hydrocarbon fluids and another permeability after activation in the presence of specific substances that cause particles 162 to transition from a contracted state to an expanded state. Once expansion has occurred, further water flow and/or gas flow through that area of the aggregate is prevented or substantially reduced.

As mentioned above, the membrane 114 may be constructed from any material that reacts and/or swells in the presence of an activating fluid such as water. For instance, membrane 114 may be constructed from BACEL hard foam or a hydrogel polymer. In one embodiment, the expandable material is not substantially affected by exposure to hydrocarbon fluids, so the material can be located in specific regions susceptible to detrimental incursion of water migration that can interfere with the production of hydrocarbon fluids. Alternatively, the swellable material can be provided with a coating such that when the swellable material is exposed to an activation fluid, e.g. an acid or a base, the coating is removed, allowing the packing material to swell. A particular elastomeric compound can be chosen so that it is selectively swellable in the presence of certain chemicals. This allows the swell pack to be run in a water based mud or activated at a later stage via controlled intervention.

It should be noted that the membrane 114 may either be permeable allowing fluid to flow through the membrane 114 or be only slightly permeable or impermeable. The latter configuration can be implemented according to an embodiment comprising strips of membrane material laid adjacent ports 112 or partially covering ports 112. An embodiment employing a slightly permeable or impermeable membrane strips is more fully shown in FIGS. 7 and 8.

In one embodiment, the valve 110 does not transition directly from the open state 116 to the closed state 118. In this embodiment, the valve 110 gradually moves from the open state 116 to the closed state 118 so that as more water flows in time, the valve closes more and more (the permeability of the membrane 114 is reduced) until it reaches total shut off or the closed state 118.

Figure 3:
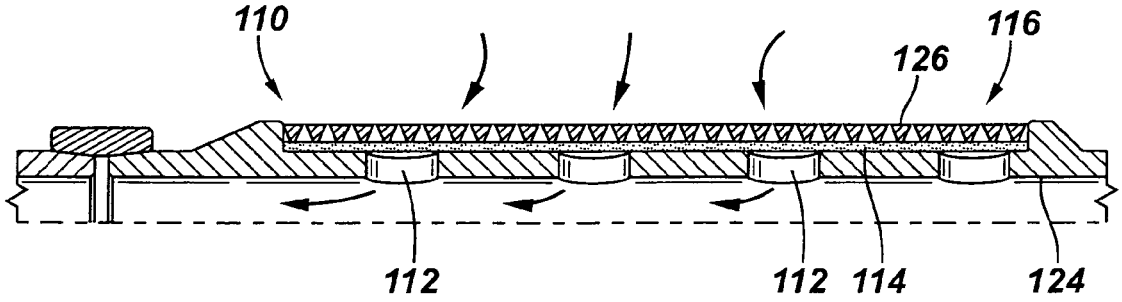
FIG. 3, is a cross-section view of a valve along with a screen having a swellable component in a dormant condition, according to an embodiment of the present invention.
Figure 4:
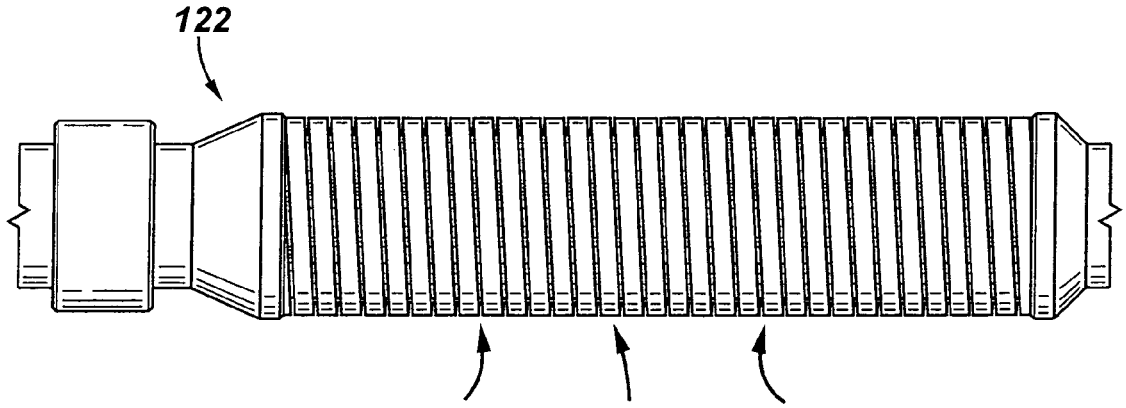
FIG. 4, is a top view of a valve along with a screen having a swellable component in a dormant condition, according to an embodiment of the present invention.

The valve 110 may be used without additional components other than the ports 112 and membrane 114. However, in some cases, as shown in FIGS. 3-8, the valve 110 is incorporated in another downhole tool. The downhole tool illustrated in the FIGS. 3 and 4 is a sand screen 122. The sand screen 122 comprises a base pipe 124 and a screen 126 typically surrounding the base pipe 124. In this embodiment, the ports 112 are constructed through the base pipe 124 and the membrane 114 is positioned between the screen 126 and base pipe 124. The membrane 114 may be embedded in the sand screen 122 as shown.

Figure 5:
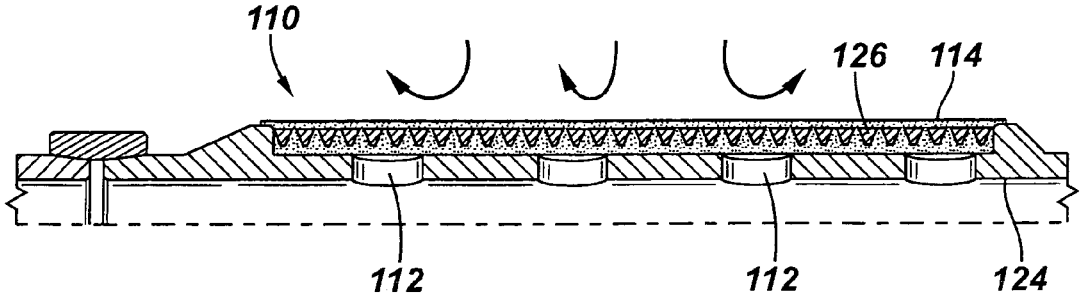
FIG. 5, is a cross-section view of a valve along with a screen having a swellable component in a swollen condition, according to an embodiment of the present invention.
Figure 6:
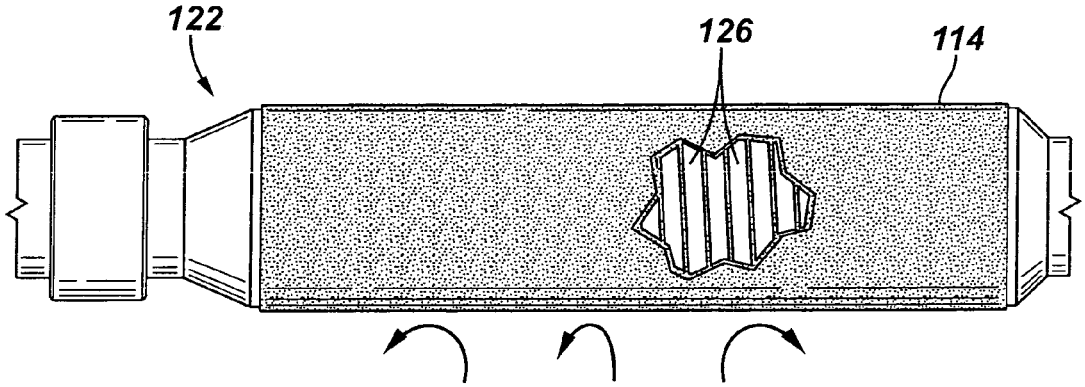
FIG. 6, is a top view of a valve along with a screen having a swellable component in a swollen condition, according to an embodiment of the present invention.

Turning to FIGS. 5 and 6, in one embodiment, when the valve 110 is in the closed state 118, the membrane 114 swells through the screen 126 thus not only prohibiting flow through the ports 112 but also through the screen 126.

Although a sand screen 122 is shown in the FIGS. 3-8, the valve 110 may be incorporated into other downhole tools. For instance, the valve 110 may be incorporated into perforated tubulars or slotted liners.

Figure 7:
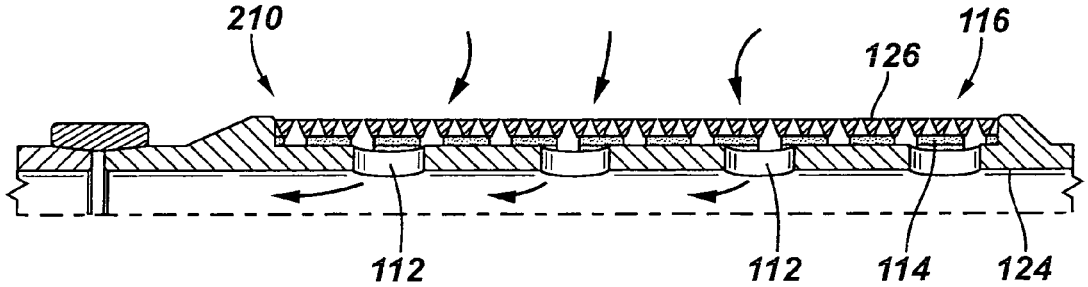
FIG. 7, is a cross-section view of a valve along with a screen having a sectioned swellable component in a dormant condition, according to an embodiment of the present invention.
Figure 8:
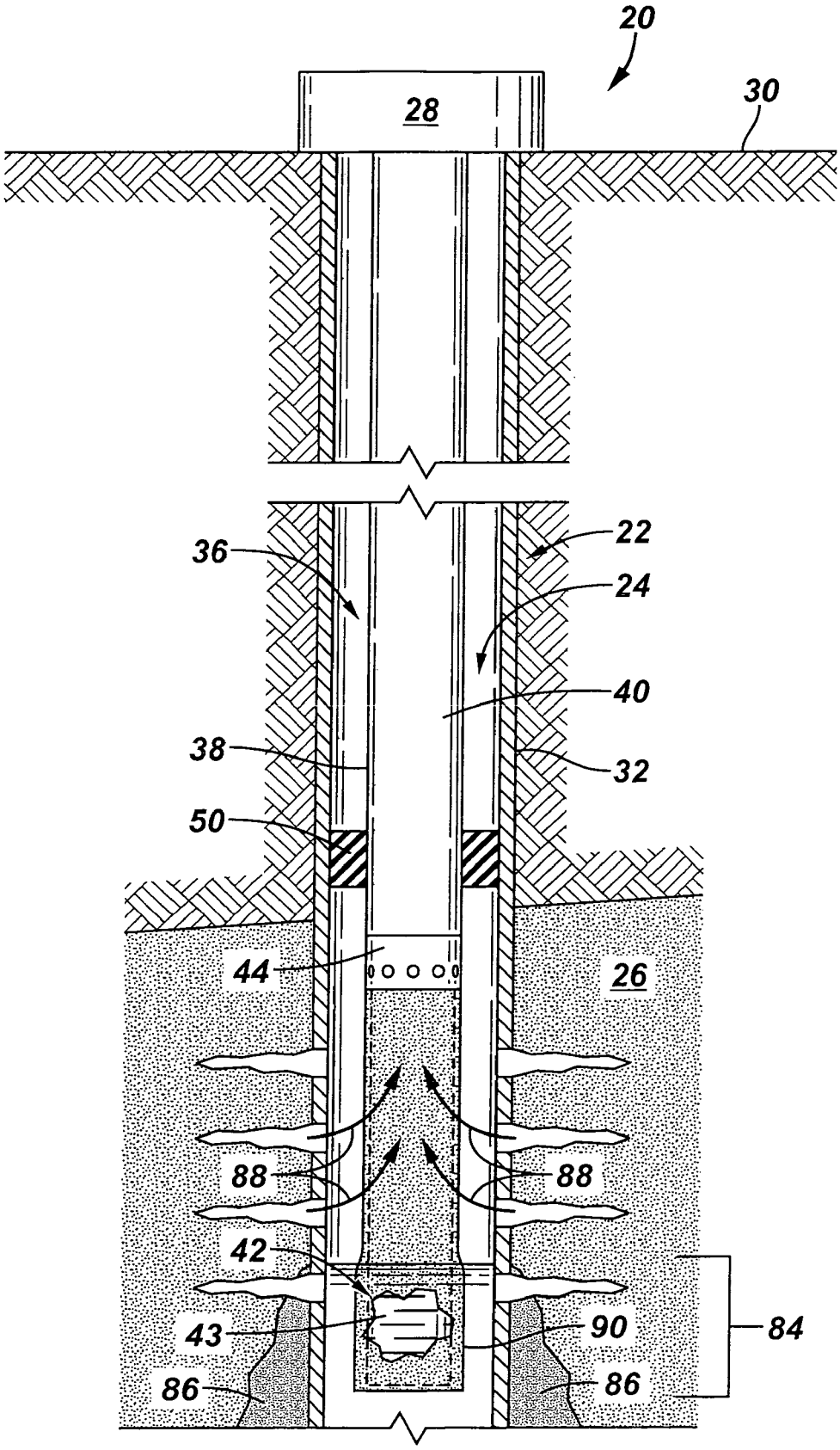
FIG. 8 is a schematic view of a well in which a completion has been positioned that includes a valve according to an embodiment of the present invention.

Turning now to FIGS. 7 and 8, an embodiment is shown wherein the membrane 214 is made up of multiple strips or a single strip wrapped about the circumference of the base pipe 124. In such embodiment, membrane 214 is wrapped either in an overlapping pattern or with gaps between each successive wrapping. For example, gaps between each successive wrap, as shown in FIG. 7 may be employed when using a low permeable or impermeable membrane 214, such that ports 112 are fully open or only partially covered by the strips of membrane 214. When valve 210 is in an open position, the gaps allow passage of formation fluids from the formation and into the ports 112. When valve 210 begins transition to a closed position, the membrane 214 swells or expands to close the gaps, and if permeable, reduce permeability of the membrane 214 itself. As such, the wrapped membrane 214 should be constructed to have gaps between successive wraps such that when fully swollen or expanded, the membrane 214 prevents or at least significantly restricts the flow of fluids through ports 112.

The valve 110, 210 can be autonomous and can be run as a stand-alone system without communication back to surface. The valve 110 does not require intervention to operate. However, if desired, an activating fluid may be pumped downhole to activate the system to allow transition to a closed position. For example, the activating fluid may either dissolve a coating on the membrane or activate the membrane itself to begin swelling. Further, a possible intervention is possible in order to fully open the zones again by re-energizing or removing the membrane 114 and replacing it with a new membrane 114 if required.

In alternate embodiments, membrane 114, 214 can be formed with a barrier or coating. The coating can be used to protect membrane 114, 214 from exposure to a swell inducing substance, e.g. water or other specific substances, until a desired time. Then, the coating can be removed by an appropriate chemical, mechanical or thermal procedure. For example, a suitable chemical can be pumped downhole to dissolve certain coatings and to expose the underlying swellable material of membrane 114, 214. In other embodiments, membrane 114, 214 can be formed of a swellable elastomeric material covering a non-elastomeric based material. Depending on the material used, swellable material 114, 214 and thus swell pack 158 can be designed to swell only when the fluid flowing through the pack reaches a water content exceeding a certain percentage. Or, the swellable material can be selected to swell to different sizes depending on the percentage of water in fluids contacting the swellable material.

Membrane 114, 124 can be formed from various materials that sufficiently swell or expand in the presence of water or other specific substances without undergoing substantial expansion when exposed to hydrocarbon based fluids. Materials that may be used in the applications described herein include elastomers that swell in the presence of water or other specific substances. Examples of swellable materials are nitrile mixed with a salt or hydrogel, EPDM, or other swelling elastomers available to the petroleum production industry. In other embodiments, additional swellable materials such as super absorbent polyacrylamide or modified crosslinked poly (meth)acrylate can be used. Examples of coatings comprise organic coatings, e.g. PEEK, nitrile or other plastics, and inorganic materials, e.g. salt (CaCl), which are readily dissolved with acids. Furthermore, the membrane 114, 214 may contain multiple layers of material to control future packing densities. Coatings also can be applied to control exposure of the swelling elastomer to water or other swell inducing substances, or to provide complete isolation of the swelling elastomer until the coating is removed by chemical, mechanical or thermal means at a desired time.

Referring to another embodiment, illustrated in FIG. 8, a portion of membrane 90 may swell as some of the membrane 90 are exposed water or other swell inducing substances. As illustrated, a portion 84 of swellable material 62 and swell pack 58 has expanded due to contact with a swell inducing substance 86. By way of example, substance 86 is illustrated as water in the form of watercut progressing along the wellbore and causing membrane 90 to swell. The expanded pack membrane portion 84 blocks inflow of fluids at that specific region while continuing to permit inflow of fluid, e.g. hydrocarbons, from formation 26 at other regions. The inflow of well fluid is indicated by arrows 88.

Figure 9:
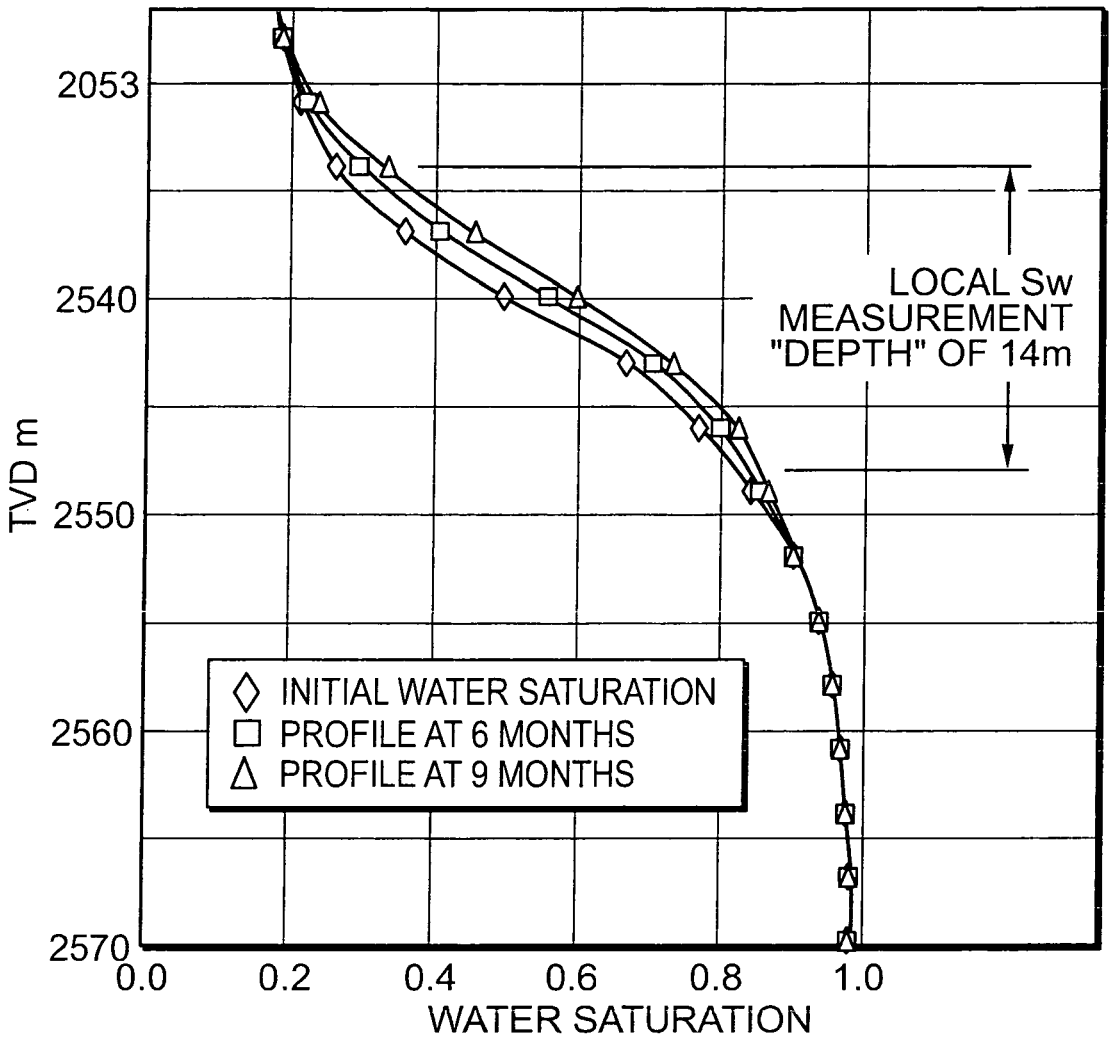
FIG. 9 is a chart indicating the saturation of water ingress to the wellbore over time versus true vertical depth of the well.

FIG. 9 depicts the saturation of water ingress to the wellbore over time versus true vertical depth of the well to give an indication of how pressure drawdown on the well impacts water progression into the wellbore and specific points in a lateral well, or horizontal section within the same well. Although not necessary, it is preferable the valve, according to the disclosed subject matter, would allow and even draw down over time to be able to establish the saturation point across the TVD pay sections of the well to reach close to 100% saturation at the same time ensuring maximum sweep of the reservoir to maximize the recovery of this well. The valve preferably allows that the locations producing water are shut off automatically ensuring the well is not killed and allow the water to migrate to another section of the well ensuring oil is swept through initially in front (water drive). As the process to sweep oil is managed through the shut off of water along the length of the product, maximized recovery of oil hydrocarbons will be gained. The saturated zones need not necessarily shut off 100% of the flow area, as oil can still be produced along with the water, hence the relative permeability of the product once activated may be able to leave a choked, but not necessarily completely restricted, area to allow production of water and oil through, albeit at a reduced rate to further increase oil recovery. When activated, these choke areas maybe constructed through predefined pattern design of the swellable membrane or pre-embedded tubes that allow a predetermined amount of flow (production) through the membrane after full activation by water.

Figure 10:
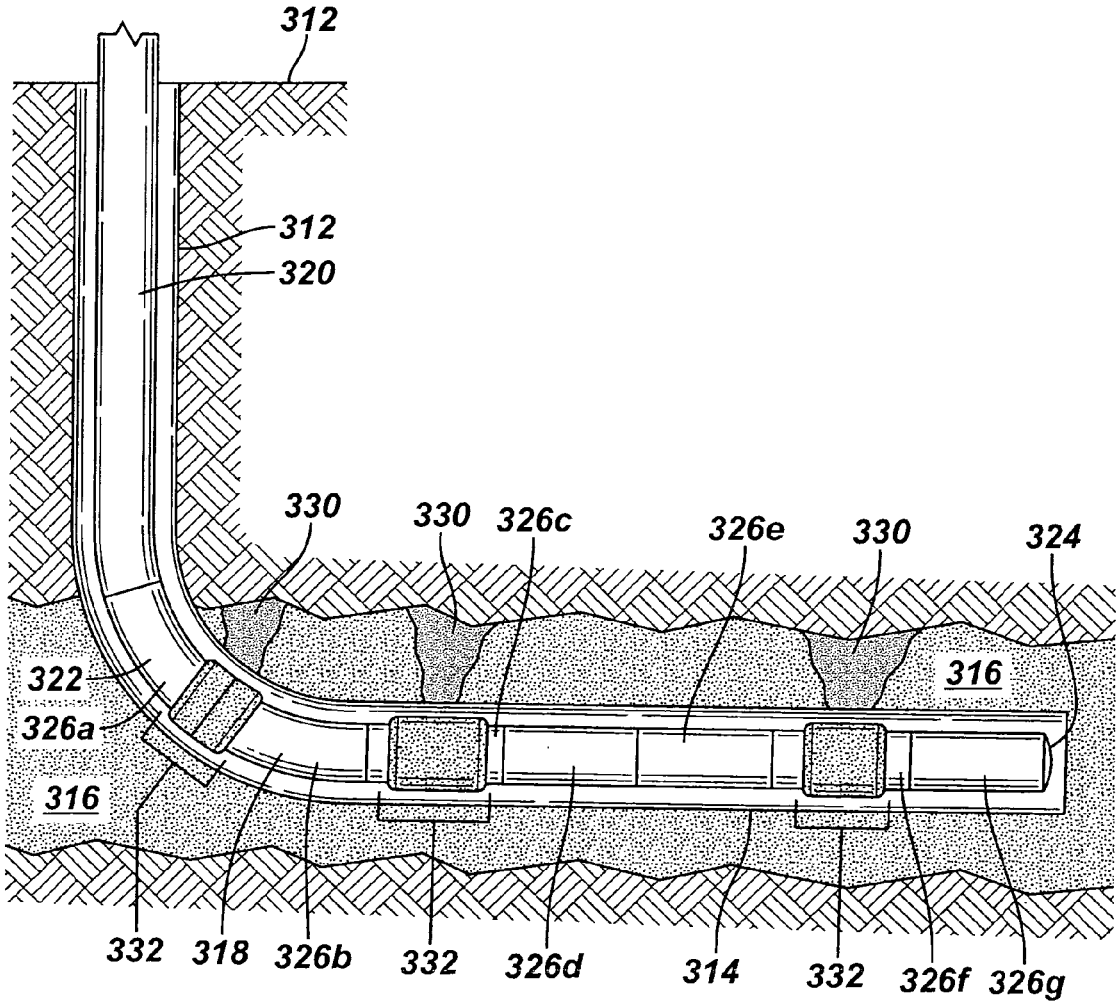
FIG. 10 is a schematic view of a well in which a completion has been positioned that includes multiple valves according to an embodiment of the present invention.

Turning to FIG. 10, generally illustrated is a main well bore 310 extending from the surface 312 downwardly. A lateral well bore 314 extends from the main well bore 310 and intersects a hydrocarbon formation 316. A completion 318 extends within the later well bore 314 and includes a "toe" 324 at the far end of the completion and a "heel" 322 at the near end of the completion 318. The completion 318 is connected to, for instance, tubing string 320 that extends within the main well bore 310 to the surface 312.

Essentially, the completion 318 is divided into sections 326(*a-g*) from the heel 322 to the toe 324, and the sections 326 are multiple sections of screen assemblies, for example, incorporating the swellable membrane or strips, described herein. As water approaches and enters the sand screen 122 at one location, the membrane embedded within each screen assembly 326 reacts and swells to stop production of water at the localized position. Once the water migrates through to another part of the screen 122 and the embedded membrane in that part reacts and swells, a greater area of flow will be shut off until the flow is completely shut off due to water saturation. For example, FIG. 10 illustrates multiple water inflow regions 330 at various locations along the lateral bore. As water contacts screen assemblies 326*a*, 326*b* and 326*f*, the embedded membrane swells or expands over those regions in contact with the water inflow. Swollen membrane regions 332 prevent or restrict water inflow in a localized manner. Further, it should be noted that although screen assemblies are daisy chained as separate assemblies, the embedded membrane can be constructed to allow swelling across screen joints, such as shown for screen assemblies 326*a* and 326*b*. Localized swelling of portions of the embedded membrane continues so long as new regions of water inflow occur.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of forming controlling flow of wellbore fluids in a wellbore used in the production of hydrocarbons, comprising:

forming a membrane layer comprising elastomeric material that swell in the presence of an activating substance;

wrapping the strips of membrane layer around a cicumference of a base pipe in contact with wellbore fluids in a manner providing gaps between the wraps, the base pipe comprising one or more radial ports therethrough; and wherein the strips of the membrance layer expand to cover the one or more radial ports, thereby restricting flow of wellbore fluid through the one or more radial ports when in contact with the activating substance.

2. The method as recited in claim 1, wherein forming comprises using a material that wells in the presence of water.

3. The method as recited in claim 1, wherein forming comprises using a material that swell in the presence of preselected chemical agents.

4. The method as recited in claim 1, wherein forming comprises using a material that swell upon exposure to a fluid with a water content above a given percentage.

5. The method as recited in claim 1, wherein forming comprises using a material that swells in proportion to the water content of a contacting fluid.

6. The method as recited in claim 1, further comprising covering the membrane with a coating to delay swelling until removal of the coating at some time after initial placement downhole of the membrane layer.

7. A valve for use in a subterranean wellbore,comprising;

a base pipe having at least one radial port therethorugh;

a membrance comprising two or more strips circumscribling the base pipe in overlapping pattern, the membrance exposed to the wellbore; and wherein the membrane expands to cover the at least one radial port thereby restricting fluid flow through the port when an activating fluid contacts the membrane.

8. The valve of claim 7 further comprising;

a screen surrounding the pipe, wherein the membrane is positioned between the base pipe and the screen.

9. The valve of claim 7 wherein the activating fluid is water.

10. The valve of claim 7 wherein the activating fluid is a preselected chemical agent.

11. The valve of claim 7 wherein the membrane swells upon exposure to a fluid with a water content above a given percentage.

12. The valve of claim 7 wherein the membrane swells in proportion to the water content of a contacting fluid.

13. The valve of claim 7 wherein the membrane comprises a coated elastomeric base material.

14. A valve for use in a subterranean wellbore, comprising;

a base pipe having at least one radial port therethrough;

a membrane comprising at least one strip poritioned about the base pipe, the membrane exposed to the wellbore;

wherein the membrane expands to cover the at least one radial port thereby restricting fluid flow through port when an activating fluid contacts the membrane; and wherein the membrane strip is wrapped about the base pipe in a manner providing gaps between the wraps.

* * * * *